US005974588A

United States Patent [19]

Furman

[11] Patent Number: 5,974,588

[45] Date of Patent: Nov. 2, 1999

[54] PROTECTIVE GLOVE

[76] Inventor: Demetry Furman, 181 Apt. 701 John St. N., Hamilton, Canada, L8L 7Z7

[21] Appl. No.: 09/168,477

[22] Filed: Oct. 8, 1998

[51] Int. Cl.[6] ..... A41D 19/00

[52] U.S. Cl. ..... 2/159; 2/16

[58] Field of Search ..... 2/16, 20, 159, 2/160, 161.1, 161, 161.6, 161.5, 163

[56] References Cited

U.S. PATENT DOCUMENTS 3,096,523 7/1963 Bruchas ..... 2/161.1
4,137,572 2/1979 Jansson et al. ..... 2/16
4,873,998 10/1989 Joyner ..... 2/16
5,088,123 2/1992 MacDonald ..... 2/161
5,450,626 9/1995 Sorrels ..... 2/163
5,729,831 3/1998 Kuhlmann ..... 2/16

*Primary Examiner*—Diana L. Oleksa
*Assistant Examiner*—Katherine Moran

[57] ABSTRACT

A protective glove for protecting the hand of a wearer from injury from blows impacting the hand. The protective glove includes a glove having front and back faces, a plurality of digit stalls, a palm region and a wrist opening. Each of the digit stalls has a fingertip shield adjacent the tip of the respective digit stall. The glove has a knuckle shield on the back face of the glove in a knuckle area of the palm region of the glove.

18 Claims, 4 Drawing Sheets

26
15
14
12
16
13
10
2
17
11
36
13

19
18
20
13

23
21
24
19
22
18
25
20
13
26
14
15
36

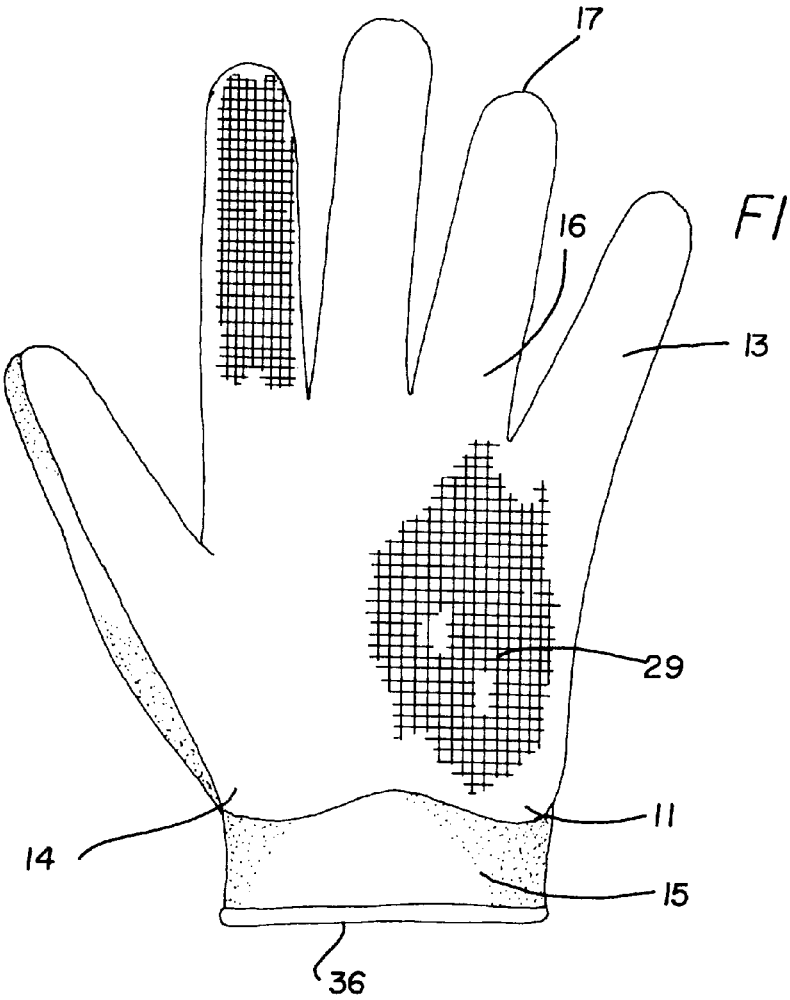
FIG.5
FIG.6
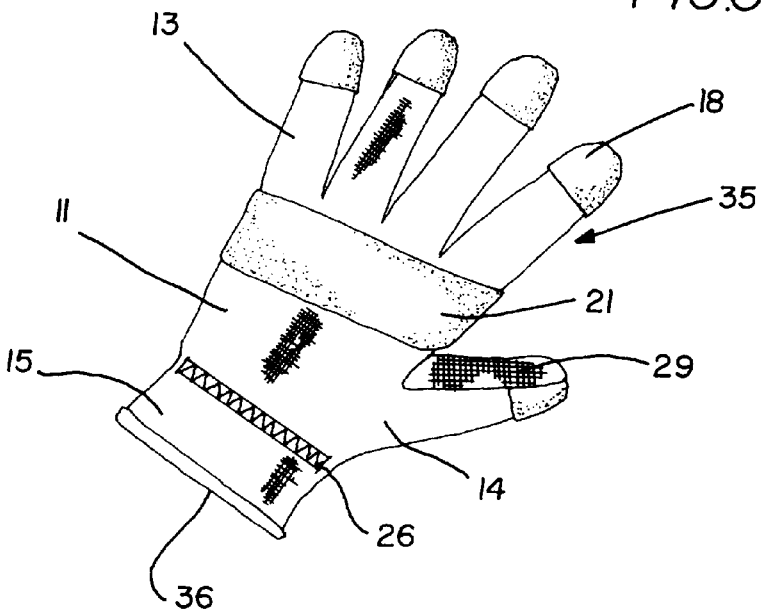

10
11
13
16
17
29
30
31
32
34
15
36

33
34
32
15

PROTECTIVE GLOVE

BACKGROUND OF THE INVENTION

1. Field of the Invention

The present invention relates to protective gloves and more particularly pertains to a new protective glove for protecting the hand of a wearer from injury from blows impacting the hand.

2. Description of the Prior Art

The use of protective gloves is known in the prior art. More specifically, protective gloves heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,916,448; U.S. Pat. No. 4,094,014; U.S. Pat. No. 5,070,540; U.S. Pat. No. 3,636,568; U.S. Pat. No. 2,217,377; and U.S. Pat. No. Des. 275,909.

While these devices fulfill their respective, particular objectives and requirements, the aforementioned patents do not disclose a new protective glove. The inventive device includes a glove having front and back faces, a plurality of digit stalls, a palm region and a wrist opening. Each of the digit stalls has a fingertip shield adjacent the tip of the respective digit stall. The glove has a knuckle shield on the back face of the glove in a knuckle area of the palm region of the glove.

In these respects, the protective glove according to the present invention substantially departs from the conventional concepts and designs of the prior art, and in so doing provides an apparatus primarily developed for the purpose of protecting the hand of a wearer from injury from blows impacting the hand.

SUMMARY OF THE INVENTION

In view of the foregoing disadvantages inherent in the known types of protective gloves now present in the prior art, the present invention provides a new protective glove construction wherein the same can be utilized for protecting the hand of a wearer from injury from blows impacting the hand.

The general purpose of the present invention, which will be described subsequently in greater detail, is to provide a new protective glove apparatus and method which has many of the advantages of the protective gloves mentioned heretofore and many novel features that result in a new protective glove which is not anticipated, rendered obvious, suggested, or even implied by any of the prior art protective gloves, either alone or in any combination thereof.

To attain this, the present invention generally comprises a glove having front and back faces, a plurality of digit stalls, a palm region and a wrist opening. Each of the digit stalls has a fingertip shield adjacent the tip of the respective digit stall. The glove has a knuckle shield on the back face of the glove in a knuckle area of the palm region of the glove.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective glove apparatus and method which has many of the advantages of the protective gloves mentioned heretofore and many novel features that result in a new protective glove which is not anticipated, rendered obvious, suggested, or even implied by any of the prior art protective gloves, either alone or in any combination thereof.

It is another object of the present invention to provide a new protective glove which may be easily and efficiently manufactured and marketed.

It is a further object of the present invention to provide a new protective glove which is of a durable and reliable construction.

An even further object of the present invention is to provide a new protective glove which is susceptible of a low cost of manufacture with regard to both materials and labor, and which accordingly is then susceptible of low prices of sale to the consuming public, thereby making such protective glove economically available to the buying public.

Still yet another object of the present invention is to provide a new protective glove which provides in the apparatuses and methods of the prior art some of the advantages thereof, while simultaneously overcoming some of the disadvantages normally associated therewith.

Still another object of the present invention is to provide a new protective glove for protecting the hand of a wearer from injury from blows impacting the hand.

Yet another object of the present invention is to provide a new protective glove which includes a glove having front and back faces, a plurality of digit stalls, a palm region and a wrist opening. Each of the digit stalls has a fingertip shield adjacent the tip of the respective digit stall. The glove has a knuckle shield on the back face of the glove in a knuckle area of the palm region of the glove.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a schematic front side view of the present invention.

FIG. 6 is a schematic back side view of the light weight embodiment of the present invention.

DESCRIPTION OF THE PREFERRED EMBODIMENT

Figure 1:
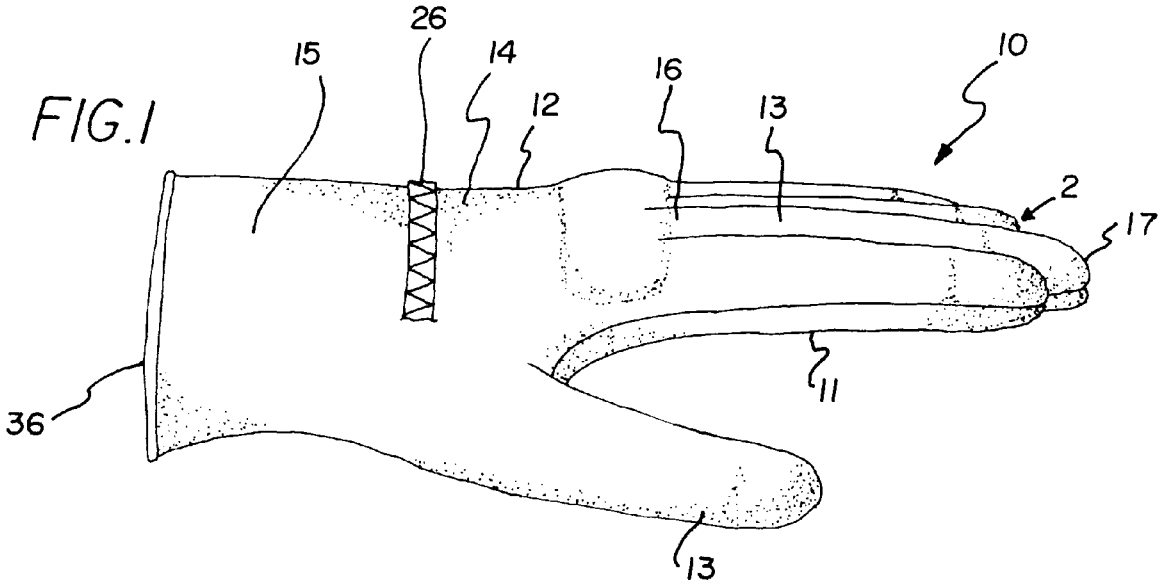
FIG. 1 is a schematic side view of a new protective glove according to the present invention.

With reference now to the drawings, and in particular to FIGS. 1 through 8 thereof, a new protective glove embodying the principles and concepts of the present invention and generally designated by the reference numeral 10 will be described.

As best illustrated in FIGS. 1 through 8, the protective glove 10 generally comprises a glove 10 having front and back faces 11,12, a plurality of digit stalls 13, a palm region 14 and a wrist opening. Each of the digit stalls 13 has a fingertip shield 18 adjacent the tip 17 of the respective digit stall 13. The glove 10 has a knuckle shield 21 on the back face 12 of the glove 10 in a knuckle area of the palm region 14 of the glove 10.

In closer detail, the protective glove 10 comprises a flexible glove 10 designed for wear on a hand of a user. The glove 10 has front and back faces 11,12, a plurality of digit stalls 13 including a thumb stall and a plurality of finger stalls, a palm region 14 (which for the purposes of this invention is meant to define the area of the glove 10 covering the palm and back of the palm areas of a hand), a wrist opening 36 for inserting a hand of a user into the glove 10, and a wrist region 15 between the palm region 14 and the wrist opening 36.

Each of the digit stalls 13 has a root 16 located adjacent the palm region 14 and terminates at a tip 17. Each of the digit stalls 13 has a length defined between the root 16 and tip 17 of the respective digit stall 13.

Figure 2:
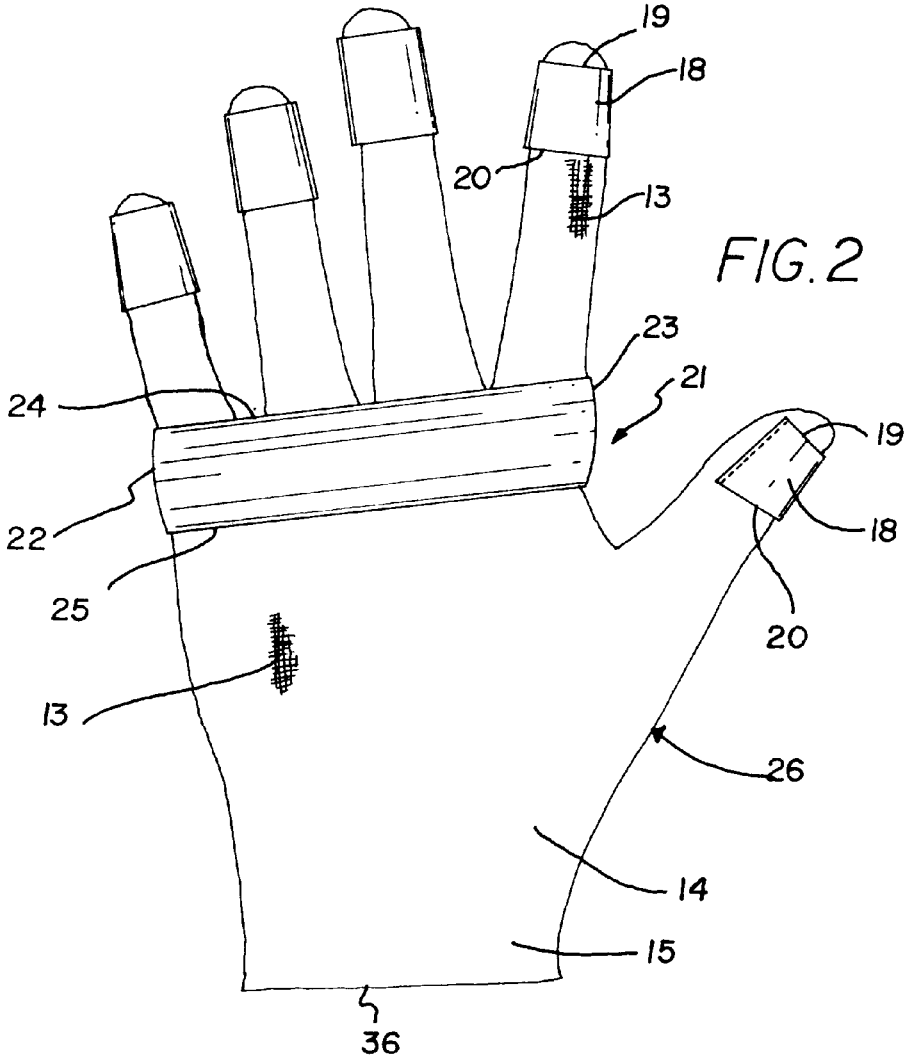
FIG. 2 is a schematic back side view of the inner layer removed from the glove of the present invention.
Figure 3:
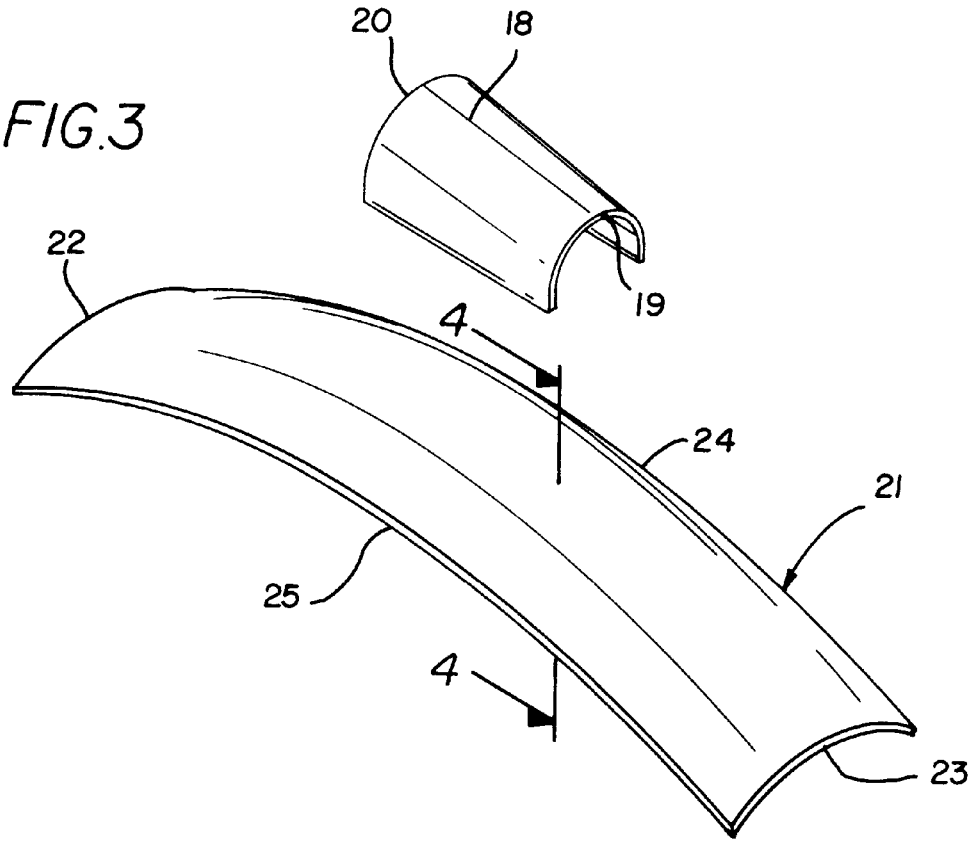
FIG. 3 is a schematic perspective view of a fingertip shield and the knuckle shield of the present invention.

Each of the digit stalls 13 has a fingertip shield 18 adjacent the tip 17 of the respective digit stall 13. In use, the fingertip shield 18 is designed for protecting the fingertips of a hand of a user in the glove 10 from a blow to the fingertips of the hand of the user. The fingertip shields 18 each comprise a material having a greater rigidity than the glove 10. Ideally, the fingertip shields 18 each comprise a rigid polyurethane plastic material. As illustrated in FIG. 3, each of the fingertip shields 18 has front and back ends 19,20. The front end 19 of each of the fingertip shields 18 is positioned adjacent the tip 17 of the associated digit stall 13. The front and back ends 19,20 of each of the fingertip shields 18 preferably lie in generally parallel planes to one another. Optionally, the front and back ends 19,20 of the fingertip shield 18 may lie in planes extending at an acute angle to one another (especially for the fingertip shield 18 on the thumb stall as illustrated in FIG. 2). In a light weight embodiment 35, shown in FIG. 6, the front end 19 of each of the fingertip shields 18 may extends over the tip 17 of the associated digit stall 13. The fingertip shields 18 each have a length defined between the front and back ends 19,20 of the respective fingertip shield 18. The length of each fingertip shield 18 extends less than one-third the length of the associated digit stall 13 such that the fingertip shields 18 only cover the area from the fingertip to the first finger joint closest to the fingertip of the finger of the user inserted into the respective digit stall 13 so that the fingertip shields 18 do not hinder the bending of the digit stalls 13 by the fingers of the user. Each of the fingertip shields 18 has a generally C-shaped arcuate transverse cross section taken generally perpendicular to the length of the respective fingertip shield 18. Each of the fingertip shields 18 also has a width tapering from the back end 20 to the front end 19 of the respective fingertip shield 18. The fingertip shields 18 are positioned on the back face 12 of the associated digit stall 13. Each of the fingertip shields 18 covers less than one-half a circumference around the associated digit stall 13 such that the fingertip shields 18 do not substantially extend into the front face 11 of the glove 10.

Figure 4:
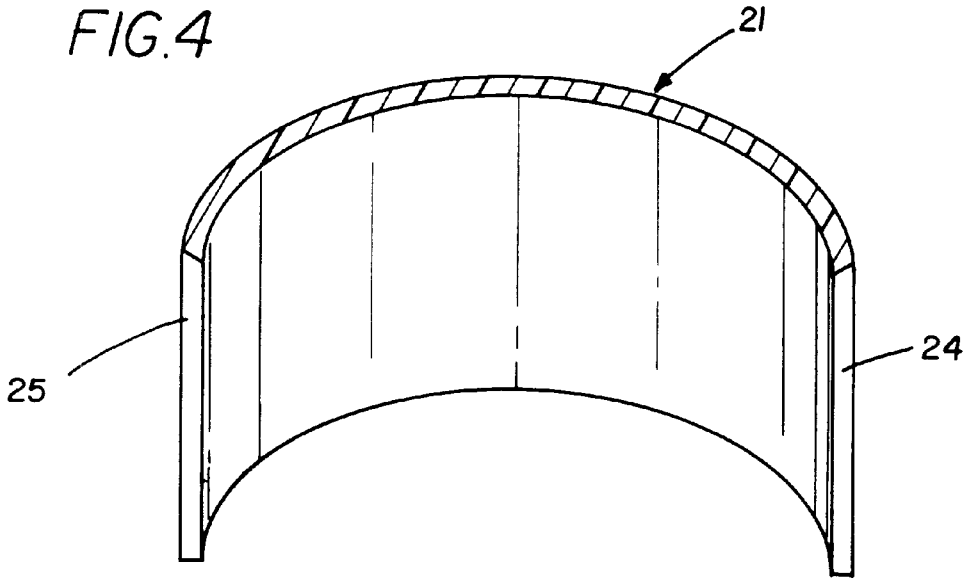
FIG. 4 is a schematic cross sectional view of the knuckle shield taken from line 4—4 of FIG. 3.

The glove 10 also has a knuckle shield 21 on the back face 12 of the glove 10 in a knuckle area of the palm region 14 of the glove 10 adjacent the roots 16 of the digit stalls 13 adapted for positioning knuckles of a handle of a user there adjacent. The knuckle shield 21 is designed for protecting the knuckles of a hand of a user in the glove 10 from a blow to the knuckles of the hand of the user. The knuckle shield 21 comprises a material having a greater rigidity than the glove 10. As illustrated in FIG. 3, the knuckle shield 21 has a pair of ends 22,23 and a pair of sides 24,25 extending between the ends of the knuckle shield 21. The knuckle shield 21 has a length defined between the ends 22,23 of the knuckle shield 21 and a width defined between the sides 24,25 of the knuckle shield 21. Ideally, length of the knuckle shield 21 extends substantially across the entire width of the front face 11 of the glove 10 in the palm region 14. Also ideally, the width of the knuckle shield 21 is about equal to the length of one of the fingertip shields 18. As illustrated in FIG. 4, the knuckle shield 21 has a generally C-shaped arcuate transverse cross section taken generally perpendicular to the length of the knuckle shield 21 for comfortably fitting of the knuckles of the hand of a user.

The back face 12 of the glove 10 preferably has a resiliently elastic strip 26 on the palm region 14 towards the wrist opening 36 of the glove 10, preferably at the union of the palm region 14 with the wrist region 15. The elastic strip 26 extends generally perpendicular to the finger stalls. In use, the elastic strip 26 is designed for constricting the glove 10 around the wrist of the wearer.

Preferably, the glove 10 comprises essentially coextensive inner and outer layers 27,28. The fingertip shields 18 and the knuckle shield 21 are interposed between the inner and outer layers 27,28 of the glove 10. As illustrated in FIG. 2, the fingertip shields 18 and the knuckle shield 21 are coupled to the inner layer 27 of the glove 10. The inner layer 27 of the glove 10 preferably comprises a flexible cloth material and the outer layer 28 of the glove 10 preferably comprises a flexible leather material.

Figure 7:
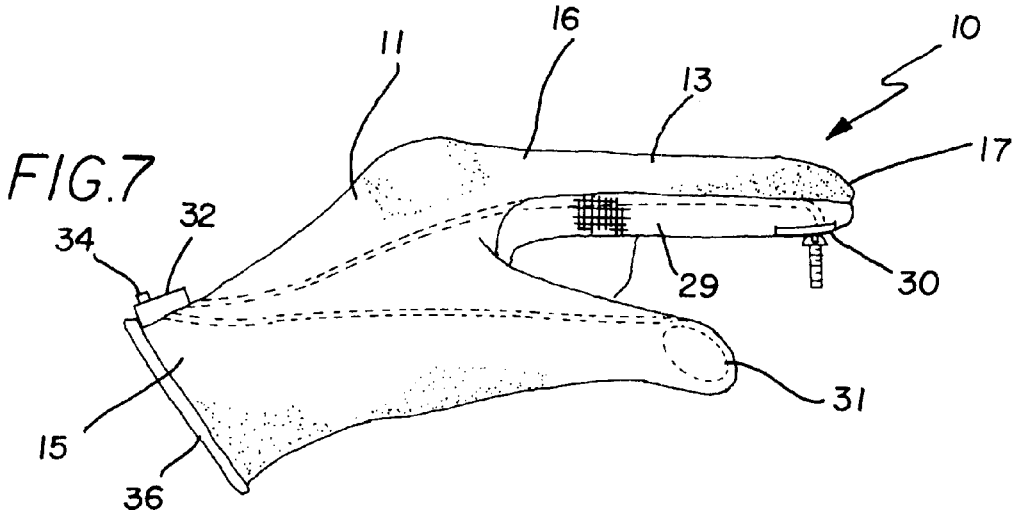
FIG. 7 is a schematic side view of the present invention with an electromagnet.
Figure 8:
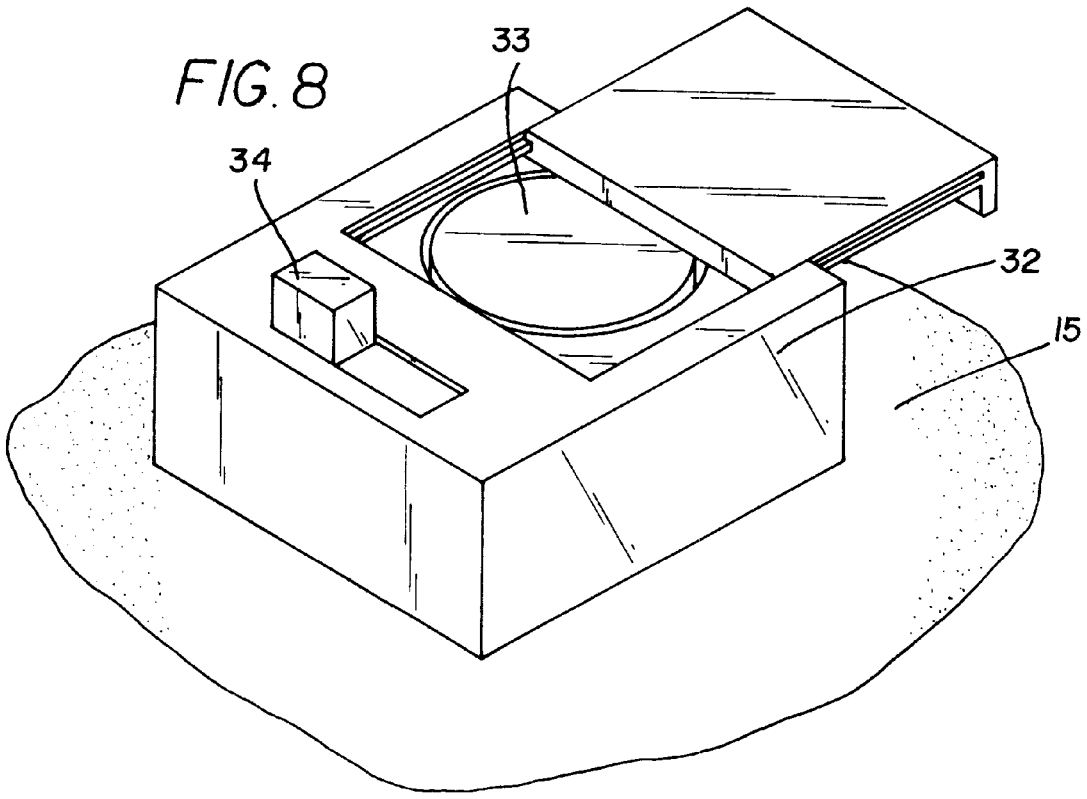
FIG. 8 is a schematic enlarged perspective view of the housing of the electromagnet.

With reference to FIGS. 5 and 7, the front face 11 of the glove 10 preferably has a flexible wire mesh 29 provided thereon which substantially covers the front face 11 portions of the digit stalls 13 and the palm region 14. The flexible wire mesh 29 is designed for protecting the front palm of the hand of the wearer. In one preferred embodiment, the flexible wire mesh 29 comprises a magnetically conductive metal. Ideally, the flexible wire mesh 29 comprises titanium for maximum strength and high magnetic conductivity. In the preferred embodiment, the flexible wire mesh 29 is magnetized to magnetically attach metal items thereto. In another preferred embodiment, as illustrated in FIG. 7, the glove 10 has an electromagnet with an electromagnetic contact 30,31 on the front face 11 of each digit stall 13 adjacent the tip 17 of the respective digit stall 13. Optionally, the glove may be constructed so that only the index finger stall and the thumb stall have electromagnetic contacts 30,31. Each of the electromagnetic contacts 30,31 is energizable to be magnetized to permit magnetic attachment thereto of metal items. The electromagnet has a housing 32 mounted to the back face 12 of the glove 10 adjacent the wrist opening 36. The housing 32 has a battery 33 provided therein which is electrically connected to the electromagnetic contacts 30,31 to energize the electromagnetic contacts 30,31. The housing 32 also has a switch 34 provided thereon electrically connected to the electromagnetic contacts 30,31 to permit a user to selectively energize the electromagnetic contacts 30,31.

With reference to FIG. 6, in the light weight embodiment 35 the glove 10 comprises only a single layer of a breathable cloth fabric. The knuckle shield and the fingertip shields in embodiment preferably comprise a leather material with the fingertip shield 18 extending around the entire circumference of the respective digit stall 13 to substantially cover the tip 17 of the respective digit stall 13.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective glove, comprising:

a glove having front and back faces, a plurality of digit stalls, a palm region and a wrist opening;

each of said digit stalls having a root located adjacent said palm region and terminating at a tip, each of said digit stalls having a length defined between said root and tip of the respective digit stall;

each of said digit stalls having a fingertip shield adjacent said tip of the respective digit stall, said fingertip shield being for protecting the fingertips of a hand of a user in said glove from a blow to the fingertips of the hand of the user;

said glove having a knuckle shield on said back face of said glove in a knuckle area of said palm region of said glove, said knuckle shield being for protecting the knuckles of a hand of a user in said glove from a blow to the knuckles of the hand of the user; and wherein said glove comprises essentially coextensive inner and outer layers, said fingertip shields and said knuckle shield being interposed between said inner and outer layers of said glove, said fingertip shields and said knuckle shield being coupled to said inner layer of said glove, wherein said inner layer of said glove comprises a flexible cloth material.

2. The protective glove of claim 1, wherein said fingertip shields and said knuckle shield each comprise a material having a greater rigidity than said glove.

3. The protective glove of claim 1, wherein each of said fingertip shields has front and back ends, said front end of each of said fingertip shields being positioned adjacent said tip of the associated digit stall, said front and back end of each of said fingertip shields lying in generally parallel planes to one another.

4. The protective glove of claim 3, wherein said front end of each of said fingertip shields extends over said tip of the associated digit stall.

5. The protective glove of claim 3, wherein said fingertip shields each have a length defined between said front and back ends of the respective fingertip shield, said length of each fingertip shield extending less than one-third said length of the associated digit stall.

6. The protective glove of claim 1, wherein said fingertip shields are positioned on said back face of the associated digit stall, each of said fingertip shields covering less than one-half a circumference around the associated digit stall.

7. The protective glove of claim 1, wherein said front face of said glove having a flexible wire mesh provided thereon for protecting the front palm of the hand of the wearer.

8. The protective glove of claim 7, wherein wire mesh substantially covers the front face portions of said digit stalls and said palm region.

9. The protective glove of claim 7, wherein said flexible wire mesh is magnetized to magnetically attach metal items thereto.

10. A protective glove, comprising:

flexible glove having front and back faces, a plurality of digit stalls, a palm region and a wrist opening;

each of said digit stalls having a root located adjacent said palm region and terminating at a tip, each of said digit stalls having a length defined between said root and tip of the respective digit stall;

each of said digit stalls having a fingertip shield adjacent said tip of the respective digit stall, said fingertip shield being for protecting the fingertips of a hand of a user in said glove from a blow to the fingertips of the hand of the user;

said fingertip shields each comprising a material having a greater rigidity than said glove;

each of said fingertip shields having front and back ends, said front end of each of said fingertip shields being positioned adjacent said tip of the associated digit stall, said front and back end of each of said fingertip shields lying in generally parallel planes to one another;

wherein said front end of each of said fingertip shields extends over said tip of the associated digit stall;

said fingertip shields each having a length defined between said front and back ends of the respective fingertip shield, said length of each fingertip shield extending less than one-third said length of the associated digit stall;

each of said fingertip shields having a generally C-shaped arcuate transverse cross section taken generally perpendicular to said length of the respective fingertip shield, each of said fingertip shields having a width tapering from said back end to said front end of the respective fingertip shield;

said fingertip shields being positioned on said back face of the associated digit stall, each of said fingertip shields covering less than one-half a circumference around the associated digit stall;

said glove having a knuckle shield on said back face of said glove in a knuckle area of said palm region of said glove adjacent said roots of said digit stalls, said knuckle shield being for protecting the knuckles of a hand of a user in said glove from a blow to the knuckles of the hand of the user;

said knuckle shield comprising a material having a greater rigidity than said glove,;

said knuckle shield having a pair of ends and a pair of sides extending between said ends of said knuckle shield, said knuckle shield having a length defined between said ends of said knuckle shield and a width defined between said sides of said knuckle shield, wherein said width of said knuckle shield is about equal to said length of one of said fingertip shields;

said knuckle shield having a generally C-shaped arcuate transverse cross section taken generally perpendicular to said length of said knuckle shield;

said back face of said glove having a resiliently elastic strip on said palm region towards said wrist opening of said glove;

said glove comprising essentially coextensive inner and outer layers, said fingertip shields and said knuckle shield being interposed between said inner and outer layers of said glove, said fingertip shields and said knuckle shield being coupled to said inner layer of said glove, wherein said inner layer of said glove comprises a flexible cloth material, wherein said outer layer of said glove comprises a flexible leather material;

said front face of said glove having a flexible wire mesh provided thereon and substantially covering the front face portions of said digit stalls and said palm region, said flexible wire mesh being for protecting the front palm of the hand of the wearer wherein said flexible wire mesh comprises a magnetically conductive metal, wherein said flexible wire mesh comprises titanium;

said glove having an electromagnet having an electromagnetic contacts on the front face of each digit stall adjacent the tip of the respective digit stall; and said electromagnet having a housing mounted to said back face of said glove adjacent said wrist opening, said housing having a battery provided therein, said battery being electrically connected to said electromagnetic contacts.

11. A protective glove, comprising:

a glove having front and back faces, a plurality of digit stalls, a palm region and a wrist opening;

each of said digit stalls having a root located adjacent said palm region and terminating at a tip, each of said digit stalls having a length defined between said root and tip of the respective digit stall;

each of said digit stalls having a fingertip shield adjacent said tip of the respective digit stall, said fingertip shield being for protecting the fingertips of a hand of a user in said glove from a blow to the fingertips of the hand of the user;

said glove having a knuckle shield on said back face of said glove in a knuckle area of said palm region of said glove, said knuckle shield being for protecting the knuckles of a hand of a user in said glove from a blow to the knuckles of the hand of the user; and said front face of said glove having a flexible wire mesh provided thereon for protecting the front palm of the hand of the wearer.

12. The protective glove of claim 11, wherein wire mesh substantially covers the front face portions of said digit stalls and said palm region.

13. The protective glove of claim 11, wherein said flexible wire mesh is magnetized to magnetically attach metal items thereto.

14. The protective glove of claim 11, wherein said fingertip shields and said knuckle shield each comprise a material having a greater rigidity than said glove.

15. The protective glove of claim 11, wherein each of said fingertip shields has front and back ends, said front end of each of said fingertip shields being positioned adjacent said tip of the associated digit stall, said front and back end of each of said fingertip shields lying in generally parallel planes to one another.

16. The protective glove of claim 15, wherein said front end of each of said fingertip shields extends over said tip of the associated digit stall.

17. The protective glove of claim 16, wherein said fingertip shields each have a length defined between said front and back ends of the respective fingertip shield, said length of each fingertip shield extending less than one-third said length of the associated digit stall.

18. The protective glove of claim 11, wherein said glove comprises essentially coextensive inner and outer layers, said fingertip shields and said knuckle shield being interposed between said inner and outer layers of said glove, said fingertip shields and said knuckle shield being coupled to said inner layer of said glove, wherein said inner layer of said glove comprises a flexible cloth material.

* * * * *